US008579422B2

(12) United States Patent
Matsuoka et al.

(10) Patent No.: US 8,579,422 B2
(45) Date of Patent: Nov. 12, 2013

(54) FLOW PATH UNIT AND IMAGE FORMING APPARATUS THAT INCLUDES FLOW PATH UNIT

(75) Inventors: Hiroki Matsuoka, Azumino (JP); Toshio Kumagai, Shiojiri (JP); Kaoru Koike, Matsumot (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

(21) Appl. No.: 13/351,703

(22) Filed: Jan. 17, 2012

(65) Prior Publication Data

US 2012/0188316 A1 Jul. 26, 2012

(30) Foreign Application Priority Data

Jan. 25, 2011 (JP) ..... 2011-012660

(51) Int. Cl.
*B41J 2/175* (2006.01)
*B41J 2/18* (2006.01)

(52) U.S. Cl.
USPC ..... 347/85; 347/89

(58) Field of Classification Search
USPC ..... 347/5, 29, 84, 85, 89
See application file for complete search history.

(56) References Cited

U.S. PATENT DOCUMENTS

| | | | | |
|---|---|---|---|---|
| 6,679,597 | B2 | 1/2004 | Ohsawa et al. | |
| 8,070,248 | B2 * | 12/2011 | Ogama | 347/14 |
| 8,205,973 | B2 * | 6/2012 | Nitta et al. | 347/85 |
| 8,240,823 | B2 * | 8/2012 | Murakami et al. | 347/85 |

FOREIGN PATENT DOCUMENTS

| | | |
|---|---|---|
| JP | 05-185600 | 7/1993 |
| JP | 2002-273867 | 9/2002 |
| JP | 2005-103841 | 4/2005 |
| JP | 2005/246854 | 9/2005 |

* cited by examiner

*Primary Examiner* — Anh T. N. Vo
(74) *Attorney, Agent, or Firm* — Workman Nydegger

(57) ABSTRACT

A flow path unit includes: a tank that accumulates a discharge fluid; a main flow path pipe that is connected to the tank and that includes a horizontal section that transfers the discharge fluid in the horizontal direction; a diverging flow path pipe that diverges in plurality from the main flow path pipe and in which each is respectively connected to a plurality of discharge units that discharge the discharge fluid; a pump; a bypass flow path pipe that is connected to the main flow path pipe; a valve that switches the flow or otherwise of the discharge fluid in the bypass flow path pipe by opening and closing; and a control unit that switches between a first control state of recycling the discharge fluid in a flow path that passes through the horizontal section.

6 Claims, 5 Drawing Sheets

FLOW PATH UNIT AND IMAGE FORMING APPARATUS THAT INCLUDES FLOW PATH UNIT

This application claims the benefit of Japanese Application No. 2011-012660, filed Jan. 25, 2011, all of which is hereby incorporated by reference.

BACKGROUND

1. Technical Field

The present invention relates to a flow path unit of a discharge fluid recycling type which is included in a droplet discharge type image forming apparatus and to an image forming apparatus that includes the flow path unit.

2. Related Art

In the related art, a technique for alleviating the sedimentation of components included in ink in a flow path has been known. For example, in JP-A-5-185600, a technique in which ink with even concentration is supplied by the spread of sedimentation or agglomerating of pigments within an ink supply tube being reduced by returning the supply ink within the ink supply tube to a supply ink retaining container via a supply ink recycling pipe is described.

In a case when a plurality of heads on which nozzles are formed are arranged in line in the horizontal direction, it can be conceived that there are sections in which the ink is transferred in the horizontal direction in pipes on the upper stream side that supply ink to such heads. Within a pipe that transfers ink in the horizontal direction, compared to an inclined pipe or a pipe that transfers ink in the vertical direction, sedimentation is not easily alleviated.

SUMMARY

An advantage of some aspects of the invention is that the sedimentation of discharge fluids within pipes that transfer ink in the horizontal direction is alleviated.

According to an aspect of the invention, there is provided a flow path unit including: a tank that accumulates a discharge fluid; a main flow path pipe that is connected to the tank and that includes a horizontal section that transfers the discharge fluid in the horizontal direction; a diverging flow path pipe that diverges in plurality from the main flow path pipe and in which each is respectively connected to a plurality of discharge units that discharge the discharge fluid; a pump; a bypass flow path pipe that is connected to the main flow path pipe; a valve that switches the flow or otherwise of the discharge fluid in the bypass flow path pipe by opening and closing; and a control unit that switches between a first control state of recycling the discharge fluid in a flow path that passes through the horizontal section, the diverging flow path pipe, the discharge unit, and the tank without passing through the bypass flow path pipe by closing the valve and a second control state that recycles the discharge fluid in a flow path that passes through the bypass flow path pipe, the horizontal section, and the tank by opening the valve and operating the pump, wherein the control unit causes the flow speed of the discharge fluid in the horizontal section in the second control state to be greater than the flow speed of the discharge fluid in the horizontal section in the first control state.

In the horizontal section, compared to a section that transfers the discharge fluid in the vertical direction, for example, sedimentation of solid components that are included in the discharge fluid within a pipe and that have greater relative weights than the liquid components that configure the discharge fluid is not easily alleviated. If sedimentation is left as is, a discharge fluid with an uneven concentration may be discharged from the discharge unit or a blockage may occur in the flow path by the sediments stagnating and solidifying, lowering the print quality.

The first control state is a state in which the discharge fluid passes through the horizontal section, the diverging flow path pipe, the discharge unit, and the tank without passing through the bypass flow path pipe, and for example, a print execution state can be supposed. The second control state is a state in which the discharge fluid is recycled in a flow path that passes through the bypass flow path pipe, the horizontal section, and the tank by opening the valve and operating the pump (including a situation in which the discharge fluid passes through a flow path other than the bypass flow path, the horizontal section, and the tank). That is, the second control state is a state in which the discharge fluid flows freely within the bypass flow path pipe by opening the valve while also operating the pump. It is possible to raise the flow speed in the horizontal section by the output of the pump. Further, since with the second control state, the number of flow paths through which the discharge fluid flows is increased as compared to the first control state, the resistance of the entire flow path is reduced, and as a result, the flow speed within the flow path is easily raised (in a case when the output of the pump is increased with the valve in a closed state, the resistance (internal pressure) increases, and harmful effects such as ink leaks from the discharge unit and damage to pipes may occur). Further, since the bypass flow path pipe can be configured by a simple shape as compared to the diverging flow path pipe that is connected to the discharge unit (the shape of the diverging flow path pipe tends to become complicated by being bent or the like), and the flow path resistance can be lowered. Here, the horizontal section is a section that is included in the main flow path pipe, and is a section in which the discharge fluid flows in both states of the first control state and the second control state.

With the aspect of the invention, by causing the flow speed in the horizontal section when the discharge fluid flows horizontally in both the first control state and the second control state greater for the second control state than for the first control state, it becomes easier to alleviate the sedimentation of the discharge fluid in the horizontal section for the second control state than for the first control state. Further, by increasing the flow speed for the second control state, the bubble emitting property of the flow path is improved, and as a result, the filling property of the discharge fluid within the flow path is improved. Here, the aspect of the invention is particularly effective in flow paths in which UV ink, titanium-oxide containing ink or metallic ink in which sedimentation easily occurs, or the like are applied as the discharge fluid.

Furthermore, in the invention, the main flow path pipe and the diverging flow path pipe include an upstream side main flow path pipe and an upstream side diverging flow path pipe that supply the discharge fluid from the tank to the discharge unit and a downstream side main flow path pipe and a downstream side diverging flow path pipe that return the discharge fluid from the discharge unit to the tank, the flow path unit including an upstream side bypass flow path pipe that is the bypass flow path pipe that is connected to the horizontal section of the upstream side main flow path pipe and a downstream side bypass flow path pipe that is the bypass flow path pipe that is connected to the horizontal section of the downstream side main body flow path pipe.

In such a case, sedimentation in the horizontal section included in the upstream side main flow path pipe and the horizontal section included in the downstream side bypass flow path pipe are alleviated for the second control state more easily than for the first control state.

In addition, in the invention, the control unit may open either an upstream side valve that is the valve included in the upstream side bypass flow path pipe or a downstream side valve that is the valve included in the downstream side bypass flow path pipe to create the second control state.

By opening either of the two valves, it is possible to increase the flow speed in the horizontal section compared to a case when both are opened even with the same pump output. It therefore becomes easier to alleviate the sedimentation within the horizontal section.

Furthermore, in the invention, a cap that depresses the nozzle face on which openings of nozzles that discharge the discharge fluid are formed may be included in the discharge unit. In such a case, in a case when the nozzle face is depressed in the second control state, the control unit may increase the output of the pump more than in a case when the nozzle face is not depressed in the second control state.

Since the discharge fluid does not leak from the nozzles even with a flow speed with the sort of pressure that exceeds the meniscus limit by the nozzle face being depressed by the cap, the flow speed in the horizontal section can be quickened by increasing the output of the pump more than when the nozzle face is not depressed. As a result, it is possible to alleviate sedimentation more quickly when the nozzle face is depressed.

According to another aspect of the invention, there is provided an image forming apparatus that includes the discharge unit and the flow path unit.

By including the discharge unit and the flow path unit, sedimentation within the main flow path is alleviated and an image forming apparatus in which sediments do not easily stagnate can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the attached drawings. Here, the same symbols are given for corresponding constituent elements in each drawing, and duplicate descriptions will be omitted.

1. First Embodiment

Figure 1:
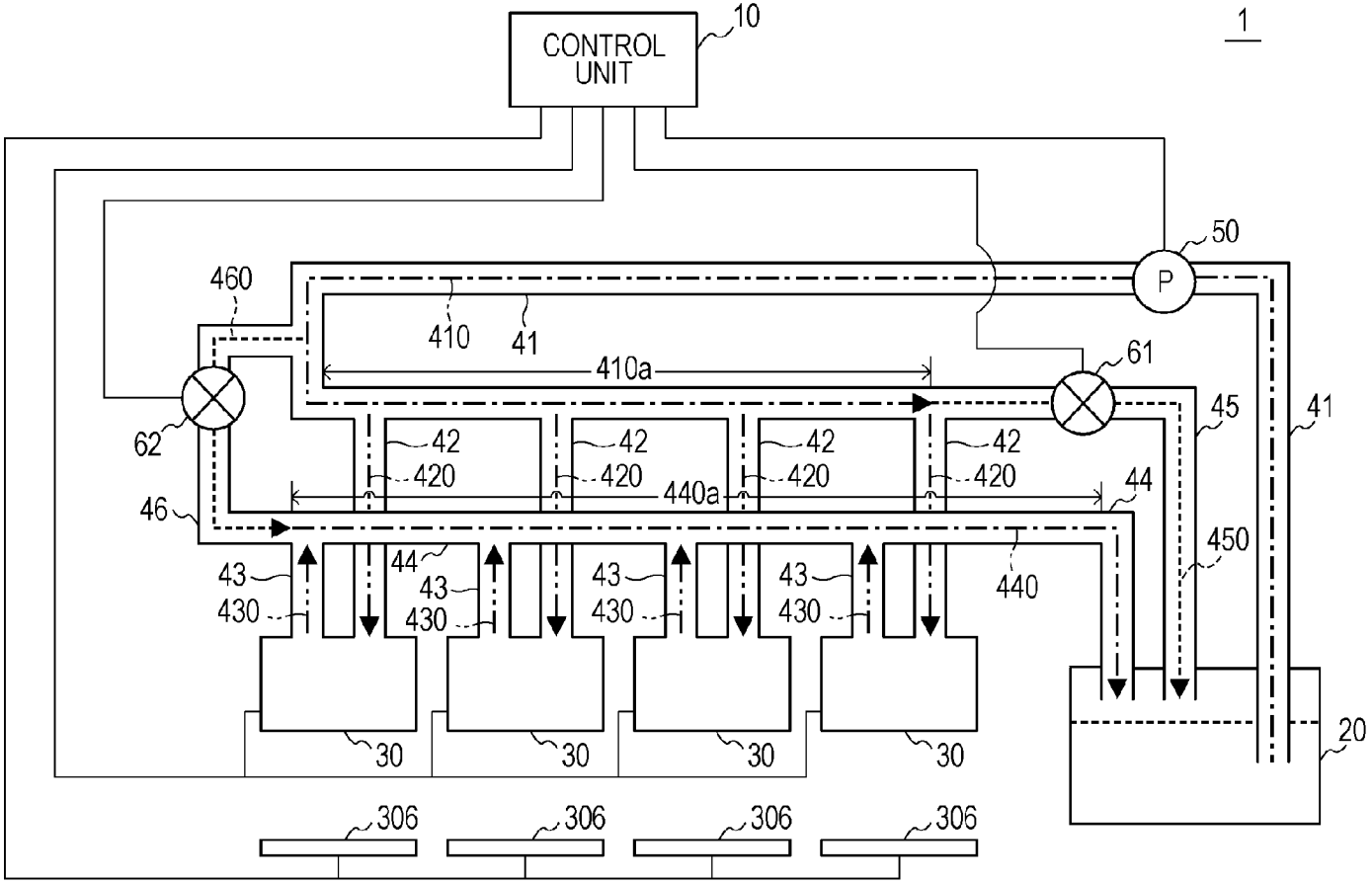
FIG. 1 is a block diagram that illustrates an image forming apparatus according to a first embodiment.

FIG. 1 is a schematic diagram that illustrates the main constituent elements of an ink jet printer 1 as an image forming apparatus according to a first embodiment of the invention. The ink jet printer 1 includes a control unit 10, an ink tank 20, discharge units 30, an upstream side main flow path pipe 41, upstream side diverging flow path pipes 42, downstream side diverging flow path pipes 43, a downstream side main body flow path pipe 44, an upstream side bypass flow path pipe 45, a downstream side bypass flow path pipe 46, a pump 50, an upstream side valve 61, a downstream side valve 62, and caps 306. The ink tank 20, the discharge units 30, the upstream side main flow path pipe 41, the upstream side diverging flow path pipes 42, the downstream side diverging flow path pipes 43, the downstream side main flow path pipe 44, the upstream side bypass flow path pipe 45, the downstream side bypass flow path pipe 46, the pump 50, the upstream side valve 61, and the downstream side valve 62 are provided for each type of ink (discharge fluid).

The control unit 10 includes a CPU, a RAM, and a ROM (not shown), and performs control of piezo elements, pumps, caps, and valves described later by the CPU executing a control program stored in the ROM. The ink tank 20 is a tank in which ink is accumulated. A plurality of discharge units 30 are arranged lined up in the horizontal direction.

The upstream side main flow path pipe 41 is a pipe that configures an upstream side main flow path 410, and is connected to the ink tank 20. The plurality of upstream side diverging flow path pipes 42 diverge to the downstream side from the upstream side main flow path pipe 41 and are respectively collected to each of the plurality of discharge units 30. The upstream side diverging flow path pipes 42 configure an upstream side diverging flow path 420. The cross-sectional area of the upstream side diverging flow path 420 (area of the cross-section that is orthogonal to the transfer direction of the ink) is smaller than the cross-sectional area of the upstream side main flow path 410. The upstream side main flow path 410 has a horizontal section 410*a* that transfers the ink in the horizontal direction in order to supply the ink to the plurality of discharge units 30 that are arranged in the horizontal direction.

The plurality of discharge units 30 are respectively connected to each of the downstream side diverging flow path pipes 43. The downstream side diverging flow path pipes 43 configure downstream side diverging flow paths 430. Each downstream side diverging flow path pipe 43 is connected to the downstream side main flow path pipe 44, and the downstream side main flow path pipe 44 is connected to the ink tank 20. The downstream side main flow path pipe 44 configures a downstream side main flow path 440. The downstream side main flow path 440 has a horizontal section 440*a* that transfers the ink in the horizontal direction in order to join with each downstream side diverging flow path 430 that is connected to the plurality of discharge units 30 that are arranged in the horizontal direction. The cross-sectional areas of the downstream side diverging flow paths 430 are smaller than the cross-sectional area of the downstream side main flow path 440.

Ink that is not discharged from the discharge units 30 returns to the ink tank 20 via the downstream side diverging flow paths 430 and the downstream side main flow path 440. That is, a recycling flow path for recycling the ink is configured in the embodiment in order to prevent the solid components included in the ink of which the relative weight is greater than the liquid components that configure the ink from sedimenting.

The upstream side bypass flow path pipe 45 is connected to the horizontal section 410*a* of the upstream side main flow path pipe 41 to the upstream side thereof, and is connected to the ink tank 20 to the downstream side. The upstream side bypass flow path pipe 45 configures an upstream side bypass flow path 450. The upstream side valve 61 that switches between the ink being and not being allowed to flow in the upstream side bypass flow path 450 is provided on the upstream side bypass flow path pipe 45. The downstream side bypass flow path pipe 46 is connected to the upstream side main flow path pipe 41 to the upstream side, and is connected to the horizontal section 440*a* of the downstream side main flow path pipe 44 to the downstream side. The downstream side bypass flow path pipe 46 configures a downstream side bypass flow path 460. The downstream side valve 62 that switches between the ink being and not being allowed to flow in the downstream side bypass flow path 460 is provided on the downstream side bypass flow path pipe 46. The cross-sectional areas of the upstream side bypass flow path 450 and the downstream side bypass flow path 460 are greater than the cross-sectional areas of the diverging flow paths 420 and 430. Further, since there is no need for the upstream side bypass flow path 450 and the downstream side bypass flow path 460 to be connected to the discharge units 30, the upstream side bypass flow path 450 and the downstream side bypass flow path 460 can be configured by a simple shape compared to the upstream side diverging flow paths 420 and the downstream side diverging flow paths 430. Therefore, compared to the diverging flow paths 420, 430, and the like, the upstream side bypass flow path 450 and the downstream side bypass flow path 460 have low flow path resistance. The upstream side valve 61 and the downstream side valve 62 are electronic magnetic valves that open or close the upstream side bypass flow path 450 and the downstream side bypass flow path 460 according to a control signal from the control unit 10.

The pump 50 is able to recycle the ink within the flow paths by suctioning ink from the ink tank 20 and transferring the ink to the upstream side main flow path pipe 41. The pump 50 is able to change the output, that is, the flow amount, according to a control of the control unit 10.

The control unit 10, the ink tank 20, the upstream side main flow path pipe 41, the upstream side diverging flow path pipes 42, the downstream side main flow path pipe 44, the downstream side diverging flow path pipes 43, the upstream side bypass flow path pipe 45, the downstream side bypass flow path pipe 46, the pump 50, the upstream side valve 61, and the downstream side valve 62 correspond to the flow path unit.

Figure 2A:
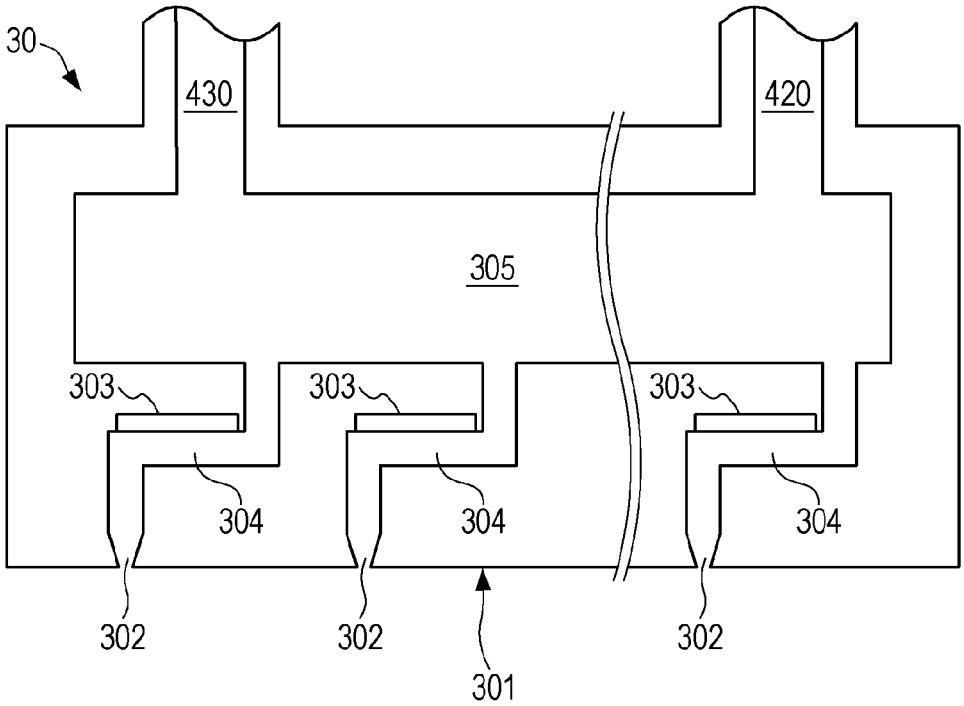
FIGS. 2A and 2B are schematic diagrams that illustrate a discharge unit according to the first embodiment.
Figure 2B:
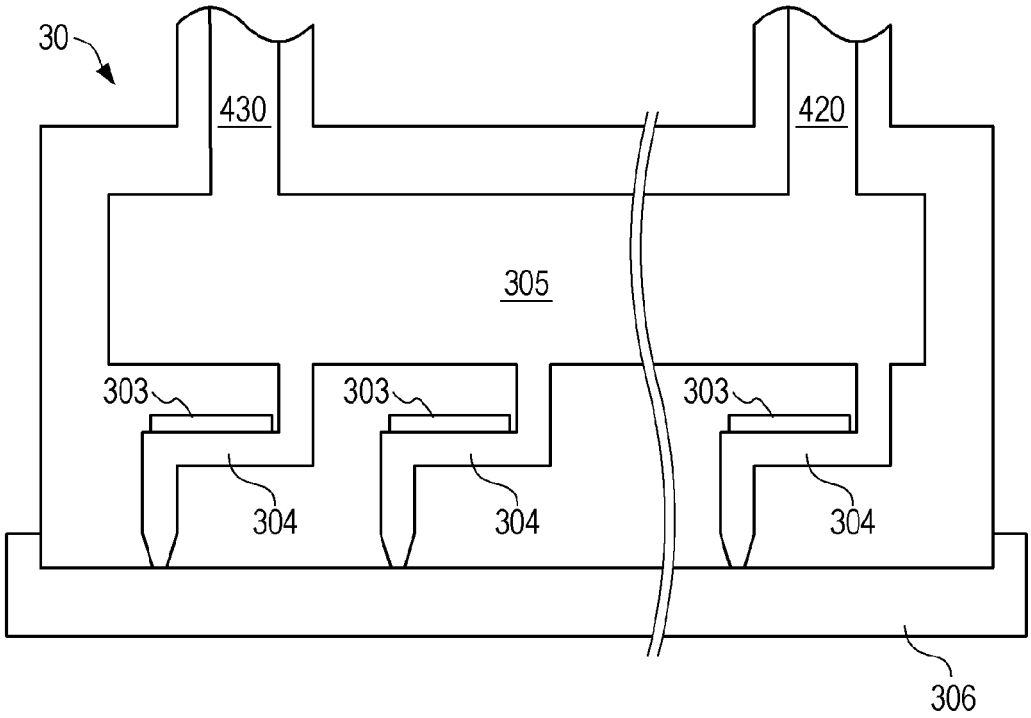

FIGS. 2A and 2B are schematic diagrams of a discharge unit 30. A common ink chamber 305 is formed on the discharge unit 30, and the common ink chamber 305 is connected to an upstream side diverging flow path 420 and a downstream side diverging flow path 430. Further, a plurality of nozzles 302 are formed on the discharge unit 30, and an opening is formed on a nozzle face 301 on each nozzle 302. A piezo element 303 and an ink chamber 304 are provided for each nozzle 302. Each ink chamber 304 is connected to the common ink chamber 305. The upstream side main flow path 410, the upstream side diverging flow paths 420, the downstream side main flow path 440, the downstream side diverging flow paths 430, the upstream side bypass flow path 450, the downstream side bypass flow path 460, the common ink chamber 305, and the ink chamber 304 are filled with ink that is supplied from the ink tank 20. When a driving voltage pulse is applied to the piezo element 303, the piezo element 303 deforms mechanically, the pressure of the ink filling the ink chamber 304 is adjusted, and ink drops are discharged from the nozzle 302.

In a print execution state, ink is suctioned from the ink tank 20 by the discharge unit 30 discharging ink drops as well as ink being suctioned from the ink tank 20 by the pump 50, and the ink is transferred to the upstream side main flow path 410. Further, the cap 306 is included on the discharge unit 30. The cap 306 adheres to the nozzle face 301 and depresses the nozzle face 301 during non-print execution (for example, during an initialization action or a maintenance action) of the ink jet printer 1 (refer to FIG. 2B). A mechanism (not shown) for depressing the nozzle face 301 with the cap 306, separating the cap 306 from the nozzle face 301, and returning to the standby position is provided on each discharge unit 30. The cap mechanism is able to carry out the above action following a control signal from the control unit 10.

Next, the control of the control unit 10 in the print execution state (first control state) and the non-print execution state (second control state) will be described. Control of the pump 50 and the valves 61 and 62 is performed so that the flow speed in the horizontal sections 410*a* and 440*a* in the non-print execution state becomes greater than the flow speed in the same sections in the print execution state. In the embodiment, the flow speed in the horizontal sections 410*a* and 440*a* during standard printing (details described below) out of the print execution state will be the standard.

Standard printing refers to recording dots on a medium at a predetermined printing speed and a predetermined recording concentration in a state in which the output of the pump 50 is stopped. Even if the pumping function of the pump 50 is stopped, ink is suctioned from the ink tank 20 by ink drops being discharged from the piezo elements 303. The printing speed refers to the area of a region that is printed per unit of time. The predetermined printing speed may be the maximum speed possible with the image forming apparatus or may be the average speed. The recording concentration may be regulated by the size of the ink drops or the number of dots per unit area. The predetermined recording concentration may be the maximum concentration possible with the image forming apparatus or may be the average concentration. In the embodiment, standard printing refers to printing with the maximum printing speed and the maximum concentration that are possible with the ink jet printer 1, and printing to cover a region of an arbitrary area with one ink color. Here, the flow speeds in the horizontal sections 410*a* and 440*a* may be obtained, for example, by emitting microwaves that penetrate the pipes to the upstream side main flow path pipe 41 and the downstream side main flow path pipe 44 and measuring the movement speeds of the particles within the ink fluid. Alternatively, the flow speeds may be obtained by obtaining the flow amount per unit of time using a flow amount sensor and obtaining the flow speed from the flow amount and the cross-sectional areas of the main flow paths 410 and 440.

Figure 3:
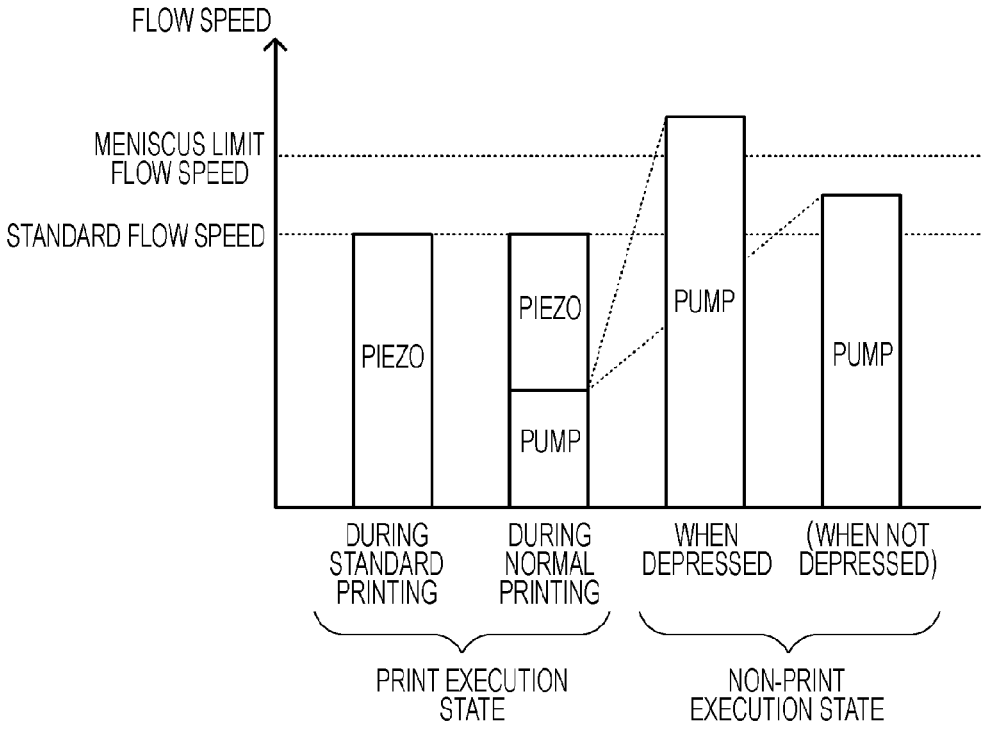
FIG. 3 is a graph that illustrates the flow speed in the horizontal section for each state according to the first embodiment.

FIG. 3 is a graph that illustrates the flow speed through the horizontal section for each state. The flow speed through the horizontal section 410*a* or the horizontal section 440*a* during standard printing is referred to as the standard flow speed. As opposed to during standard printing, during normal printing, the pumping function of the pump 50 is used in addition to the pumping function of the piezo elements 303 as an auxiliary. During normal printing, since the amount that is discharged depends on the print image data and is not fixed, the flow speed through the horizontal section may also changed if only the pumping function of the piezo elements is used. The control unit 10 therefore controls the pump 50 so that the average flow speed through the horizontal section becomes the standard flow speed by supplementing the flow speed that is unfixed due to the discharge action of the piezo elements to be changeable by the pumping function of the pump 50. As opposed to the print execution state, with the non-print execution state (for example, in a case during the initialization action before the normal printing is started, during the maintenance action, or the like when ink drops are not discharged from the nozzles 302), the control unit 10 controls each unit so that the flow speed through the horizontal section becomes greater than the flow speed through the horizontal section of the print execution state (that is, the standard flow speed) by the output value of the pump 50, the opening and closing of the valves described later, and the caps.

Figure 4A:
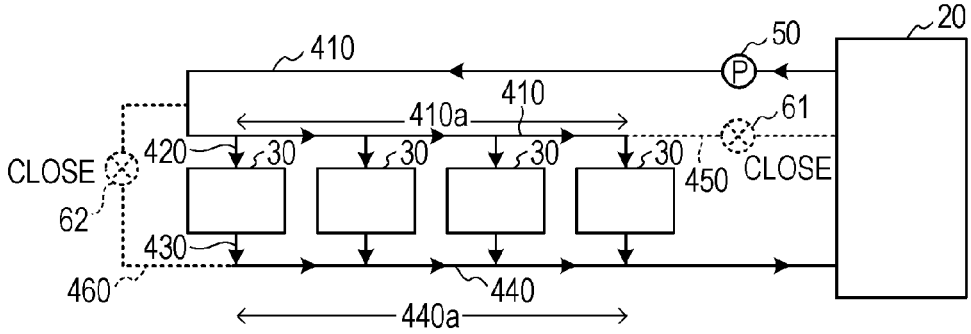
FIGS. 4A to 4D are schematic diagrams that illustrate the flow path according to the first embodiment.

FIGS. 4A to 4D are schematic diagrams that illustrate the flow paths illustrated in FIG. 1. FIG. 4A illustrates the flow path of the ink in the print execution state (first control state). During normal printing (corresponding to the normal printing in FIG. 3), the control unit 10 operates the piezo elements 303 and the pump 50 as an auxiliary in a state in which both the upstream side valve 61 and the downstream side valve 62 are closed. Accordingly, as illustrated in FIG. 4A, the ink does not flow to the upstream side bypass flow path 450 or the downstream side bypass flow path 460. The ink is supplied from the ink tank 20 to the discharge units 30 via the upstream side main flow path 410 and the upstream side diverging flow paths 420 and is discharged from the nozzles. Ink that is not discharged returns to the ink tank 20 via the downstream side diverging flow paths 430 and the downstream side main flow path 440. The output of the pump 50 is controlled so that the average flow speed through the horizontal section is the same as the standard flow speed. Here, with regard to the control of the pump 50, specifically, for example, data regulating the correspondence relationship between the information provided to the pump 50 to achieve each of the flow speeds illustrated in FIG. 3 and each situation is stored in the ROM or the like in advance, and the control unit 10 controls the output of the pump 50 in each situation using such data. The control unit 10 controls the output of the pump 50 for each state using such information. The information provided to the pump 50 is, for example, the voltage value, the number of rotations of a rotator that the pump includes, and the like.

Figure 4B:
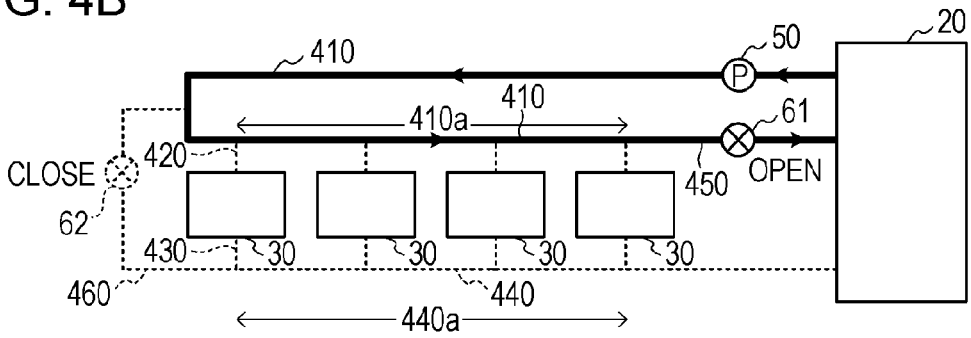
Figure 4C:
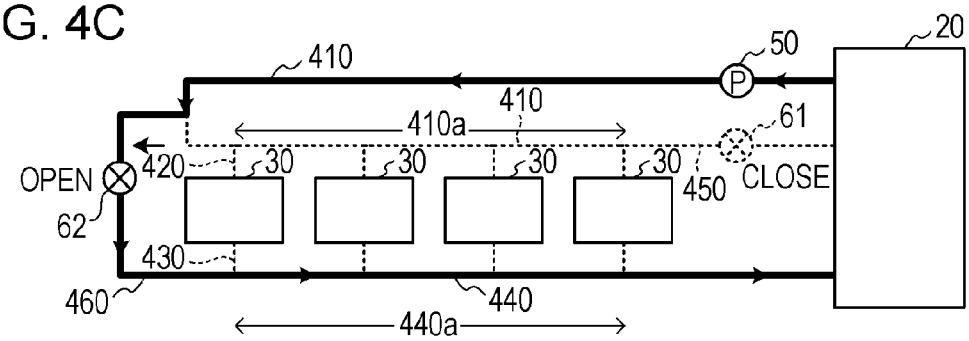

FIGS. 4B to 4C illustrate the flow path of the ink in the non-print execution state (second control state). During non-print execution, the control unit 10 operates the pump 50 be opening either the upstream side valve 61 or the downstream side valve 62 in a state in which the caps 306 depress the nozzle faces 301 (corresponding to the depressing in FIG. 3). In the embodiment, the pump 50 is controlled so that the flow speed in the horizontal sections 410*a* and 440*a* in the non-print execution state is greater than the flow speed of the same sections in the print execution state (that is, the standard flow speed).

FIG. 4B illustrates a state in which the upstream side valve 61 is opened and the downstream side valve 62 is closed. In such a case, ink does not flow to the downstream side bypass flow path 460. Further, since the ink returns to the ink tank 20 via the upstream side bypass flow path 450 which has a smaller resistance than a flow path via the discharge units 30 by the upstream side valve 61 provided on the upstream side bypass flow path 450 connected to the ink tank 20 being opened, the ink hardly flows through the upstream side diverging flow paths 420, the discharge units 30, the downstream side diverging flow paths 430, and the downstream side main flow path 440.

FIG. 4C illustrates a state in which the downstream side valve 62 is opened and the upstream side valve 61 is closed. In such a case, ink does not flow to the upstream side bypass flow path 450. The ink returns to the ink tank 20 via the downstream side bypass flow path 460 and the downstream side main flow path 440 which have a smaller resistance than a flow path via the discharge units 30 (the upstream side main flow path 410, the upstream side diverging flow paths 420, the discharge units 30, and the downstream side diverging flow paths 430). The ink hardly flows through the upstream side main flow path 410, the upstream side diverging flow paths 420, the discharge units 30, and the downstream side diverging flow paths 430.

In such a manner, in a case when only one of the valves that are provided on the bypass flow paths in the non-print execution state is opened, compared to a case when both valves are opened, the flow speeds of the upstream side main flow path 410 and the downstream side main flow path 440 can be increased even with the same pump output. It is therefore also possible to increase the flow speeds through the horizontal sections 410*a* and 440*a*, and it is easier to alleviate sedimentation in the horizontal sections 440*a* and 410*a*. When the nozzle faces 301 are depressed by the caps 306, since the ink does not leak from the nozzles 302 even with a flow speed with the sort of pressure that exceeds the meniscus limit, it is possible to cause the flow speed through the horizontal section faster than when the nozzle faces 301 are not depressed by increasing the output of the pump. As a result, it is easier to quickly alleviate sedimentation when the nozzle faces 301 are depressed.

Figure 4D:
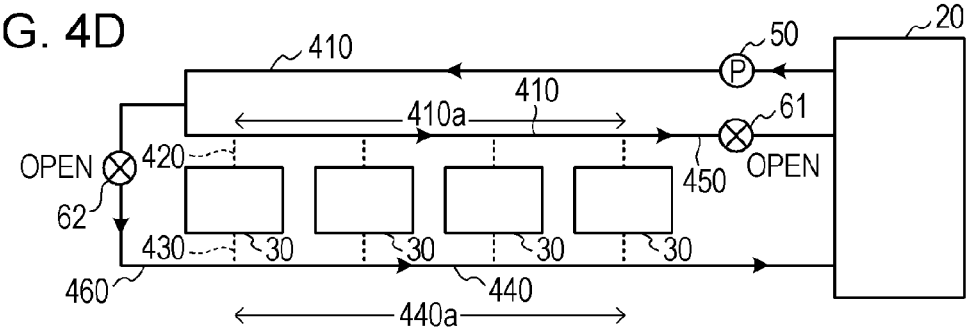

Here, in the non-print execution state, the control unit 10 may open both valves in a state in which the nozzle faces 301 are depressed by the caps 306. In a case when opening both valves, as illustrated in FIG. 4D, ink flows through the upstream side bypass flow path 450 and the downstream side bypass flow path 460 with a smaller resistance than a flow path via the upstream side diverging flow paths 420, the discharge units 30, and the downstream side diverging flow paths 430. The ink that is suctioned from the ink tank 20 therefore returns to the ink tank 20 via the upstream side main flow path 410, the upstream side bypass flow path 450, the downstream side bypass flow path 460, and the downstream side main flow path 440. In such a case, in order to increase the flow path through the horizontal sections 410*a* and 440*a*, the control unit 10 may increase the output of the pump 50 from a case when only either of the valves is opened.

2. Second Embodiment

Figure 5A:
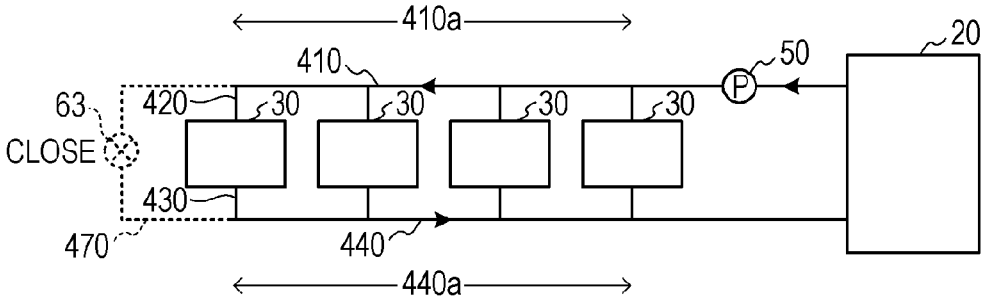
FIGS. 5A and 5B are schematic diagrams that illustrate the flow path according to another embodiment.
Figure 5B:
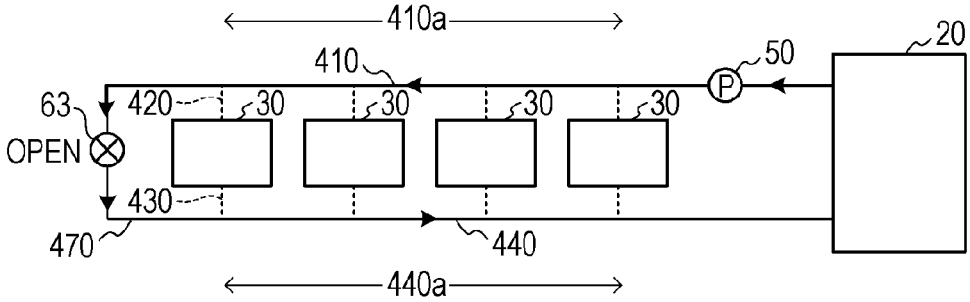

Here, needless to say, the technical scope of the invention is not limited to the embodiment described above and various modifications may be made within a range without departing from the gist of the invention. FIGS. 5A and 5B are diagrams that illustrate flow paths according to another embodiment. Flow paths of the configurations illustrated in the drawings are also possible. The flow paths of the FIGS. 5A and 5B are configured by a main flow path configured by a main flow path pipe that is connected to the ink tank 20 (upstream side main flow path 410 and downstream side main flow path 440), diverging flow paths configured by a plurality of diverging flow path pipes that are connected to the main flow path pipe and respectively connected to a plurality of discharge units 30 (upstream side diverging flow paths 420 and downstream side diverging flow paths 430), and a bypass flow path 470 that is configured by a bypass flow path pipe that is connected to the main flow path. A valve 63 is included in the bypass flow path 470, and the pump 50 is included in the main flow path. Ink can be supplied to the discharge units 30 by the control unit 10 closing the valve 63 during print execution. The returning path of the ink is through the ink tank 20, the upstream side main flow path 410, the upstream side diverging flow paths 420, the discharge units, the downstream side diverging flow paths 430, the downstream side main flow path 440, and the ink tank 20. During non-print execution, the control unit 10 increases the output of the pump 50 by causing the caps 306 to depress the nozzle faces 301 and opening the valve 63. The ink then flows to the side of the bypass flow path 470, avoiding the diverging flow paths 420 and 430 and the discharge units 30. As a result, it is possible to quicken the flow speed through the horizontal sections 410*a* and 440*a* than during print execution, making the alleviation of sedimentation easier.

Here, although the flow speed is increased by increasing the output of the pump 50 by depressing the nozzle faces 301 by the caps 306 during non-print execution in the embodiment described above, the nozzle faces 301 may not be depressed by the caps 306 as long as the flow speed is such that the pressure does not exceed the meniscus limit (corresponding to the non-depressing in FIG. 3).

Further, although the initialization action before normal printing, the maintenance action, and the like are exemplified as examples of the second control state (non-print execution state) in the embodiment described above, the invention is not limited thereto. Out of a plurality of inks, for example, in a case when there is unused ink (ink of which ink drops are not discharged) during the print action of the printer as a whole, in relation to such unused ink, in a non-print execution state, the control unit 10 may perform the opening and closing control of the upstream side valve 61 and the downstream side valve 62, the output control of the pump 50, or the control of the caps as described above. Here, in the specification, descriptions of "via A and B" also include situations in which paths other than A and B are passed through.

What is claimed is:

1. An image forming apparatus comprising:

a discharge unit;

a tank that accumulates a discharge fluid;

a main flow path pipe that is connected to the tank and that includes a horizontal section that transfers the discharge fluid in a horizontal direction;

a diverging flow path pipe that diverges in plurality from the main flow path pipe and in which each is respectively connected to a plurality of discharge units that discharge the discharge fluid;

a pump;

a bypass flow path pipe that is connected to the main flow path pipe;

a valve that switches a flow or otherwise of the discharge fluid in the bypass flow path pipe by opening and closing; and a control unit that switches between a first control state of recycling the discharge fluid in a flow path that passes through the horizontal section, the diverging flow path pipe, the discharge unit, and the tank without passing through the bypass flow path pipe by closing the valve and a second control state that recycles the discharge fluid in a flow path that passes through the bypass flow path pipe, the horizontal section, and the tank by opening the valve and operating the pump, wherein the control unit causes a flow speed of the discharge fluid in the horizontal section in the second control state to be greater than a flow speed of the discharge fluid in the horizontal section in the first control state, wherein a cross-sectional area of the main flow path pipe that is orthogonal to the transfer direction of the discharge fluid is greater than a cross-sectional area of the diverging flow path pipe orthogonal to the transfer direction of the discharge fluid and wherein a cross-sectional area of the bypass flow path pipe that is orthogonal to the transfer direction of the discharge fluid is greater than the cross-sectional area of the diverging flow path pipe.

2. The image forming apparatus according to claim 1, wherein the main flow path pipe and the diverging flow path pipe include an upstream side main flow path pipe and an upstream side diverging flow path pipe that supply the discharge fluid from the tank to the discharge unit and a downstream side main flow path pipe and a downstream side diverging flow path pipe that return the discharge fluid from the discharge unit to the tank, the flow path unit further includes:

an upstream side bypass flow path pipe that is the bypass flow path pipe that is connected to the horizontal section of the upstream side main flow path pipe; and a downstream side bypass flow path pipe that is the bypass flow path pipe that is connected to the horizontal section of the downstream side main body flow path pipe.

3. The image forming apparatus according to claim 2, wherein the control unit opens either an upstream side valve that is the valve included in the upstream side bypass flow path pipe or a downstream side valve that is the valve included in the downstream side bypass flow path pipe to create the second control state.

4. The image forming apparatus according to claim 1, wherein the discharge unit comprises:

a nozzle face on which openings of nozzles that discharge the discharge fluid are formed is included in the discharge unit, and a cap that is configured to depress the nozzle face, wherein in a case when the nozzle face is depressed by the cap in the second control state, the control unit increases an output of the pump more than in a case when the nozzle face is not depressed by the cap in the second control state.

5. An image forming apparatus comprising:

a discharge unit;

a tank that accumulates a discharge fluid;

a main flow path pipe that is connected to the tank and that includes a horizontal section that transfers the discharge fluid in a horizontal direction;

a diverging flow path pipe that diverges in plurality from the main flow path pipe and in which each is respectively connected to a plurality of discharge units that discharge the discharge fluid;

a pump;

a bypass flow path pipe that is connected to the main flow path pipe;

a valve that switches a flow or otherwise of the discharge fluid in the bypass flow path pipe by opening and closing; and a control unit that switches between a first control state of recycling the discharge fluid in a flow path that passes through the horizontal section, the diverging flow path pipe, the discharge unit, and the tank without passing through the bypass flow path pipe by closing the valve and a second control state that recycles the discharge fluid in a flow path that passes through the bypass flow path pipe, the horizontal section, and the tank by opening the valve and operating the pump, wherein the control unit causes a flow speed of the discharge fluid in the horizontal section in the second control state to be greater than a flow speed of the discharge fluid in the horizontal section in the first control state, wherein the main flow path pipe and the diverging flow path pipe include an upstream side main flow path pipe and an upstream side diverging flow path pipe that supply the discharge fluid from the tank to the discharge unit and a downstream side main flow path pipe and a downstream side diverging flow path pipe that return the discharge fluid from the discharge unit to the tank, the flow path unit further includes:

an upstream side bypass flow path pipe that is the bypass flow path pipe that is connected to the horizontal section of the upstream side main flow path pipe; and a downstream side bypass flow path pipe that is the bypass flow path pipe that is connected to the horizontal section of the downstream side main body flow path pipe.

6. An image forming apparatus comprising:

a discharge unit;

a tank that accumulates a discharge fluid;

a main flow path pipe that is connected to the tank and that includes a horizontal section that transfers the discharge fluid in a horizontal direction;

a diverging flow path pipe that diverges in plurality from the main flow path pipe and in which each is respectively connected to a plurality of discharge units that discharge the discharge fluid;

a pump;

a bypass flow path pipe that is connected to the main flow path pipe;

a valve that switches a flow or otherwise of the discharge fluid in the bypass flow path pipe by opening and closing; and a control unit that switches between a first control state of recycling the discharge fluid in a flow path that passes through the horizontal section, the diverging flow path pipe, the discharge unit, and the tank without passing through the bypass flow path pipe by closing the valve and a second control state that recycles the discharge fluid in a flow path that passes through the bypass flow path pipe, the horizontal section, and the tank by opening the valve and operating the pump, wherein the control unit causes a flow speed of the discharge fluid in the horizontal section in the second control state to be greater than a flow speed of the discharge fluid in the horizontal section in the first control state, wherein the discharge unit comprises:

a nozzle face on which openings of nozzles that discharge the discharge fluid are formed; and a cap that is configured to depress the nozzle face, wherein in a case when the nozzle face is depressed by the cap in the second control state, the control unit increases an output of the pump more than in a case when the nozzle face is not depressed by the cap in the second control state.

* * * * *